US009442453B1

(12) United States Patent
Kitagawa

(10) Patent No.: US 9,442,453 B1
(45) Date of Patent: Sep. 13, 2016

(54) CLEANING DEVICE, IMAGE FORMING APPARATUS INCLUDING CLEANING DEVICE, AND END-SEALING MEMBER FOR CLEANING DEVICE

(71) Applicant: FUJI XEROX CO., LTD., Tokyo (JP)

(72) Inventor: Yusuke Kitagawa, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/838,513

(22) Filed: Aug. 28, 2015

(30) Foreign Application Priority Data

Feb. 24, 2015 (JP) ..... 2015-033452

(51) Int. Cl.
*G03G 21/00* (2006.01)

(52) U.S. Cl.
CPC ..... *G03G 21/007* (2013.01); *G03G 21/0011* (2013.01); *G03G 2221/1648* (2013.01)

(58) Field of Classification Search
CPC ..... G03G 15/0817; G03G 15/0898; G03G 21/0011; G03G 2221/1648
USPC ..... 399/102, 105, 350
See application file for complete search history.

(56) References Cited

U.S. PATENT DOCUMENTS 4,800,411 A * 1/1989 Tanaka ..... G03G 15/0898 399/103
8,660,459 B2 * 2/2014 Azuma ..... G03G 21/0011 399/102
2005/0276627 A1 * 12/2005 Nozawa ..... G03G 15/0898 399/103

FOREIGN PATENT DOCUMENTS

JP 03155576 A * 7/1991
JP 09080906 A * 3/1997
JP 11237818 A * 8/1999
JP 2001-356600 A 12/2001
JP 2002-328574 A 11/2002

* cited by examiner

*Primary Examiner* — Robert Beatty
(74) *Attorney, Agent, or Firm* — Sughrue Mion, PLLC

(57) ABSTRACT

A cleaning device that removes a residual substance from an image carrier includes a cleaning container having an opening that faces the image carrier, the cleaning container extending in an axial direction of the image carrier and receiving the residual substance; a scraping member that extends in a longitudinal direction of the opening and scrapes off the residual substance by coming into contact with the image carrier; and an end-sealing member that is fixed to the cleaning container at least at one end of the opening, that is in contact with a surface of the image carrier, and that seals a gap between the cleaning container and the image carrier at an end of the scraping member. A surface of the end-sealing member that is in contact with the image carrier has a void in a region isolated from a surrounding region.

20 Claims, 11 Drawing Sheets

CLEANING DEVICE, IMAGE FORMING APPARATUS INCLUDING CLEANING DEVICE, AND END-SEALING MEMBER FOR CLEANING DEVICE

CROSS-REFERENCE TO RELATED APPLICATIONS

This application is based on and claims priority under 35 USC 119 from Japanese Patent Application No. 2015-033452 filed Feb. 24, 2015.

BACKGROUND

Technical Field

The present invention relates to a cleaning device, an image forming apparatus including the cleaning device, and an end-sealing member for the cleaning device.

SUMMARY

According to an aspect of the invention, there is provided a cleaning device that removes a residual substance from an image carrier that rotates, the cleaning device including a cleaning container having an opening that faces the image carrier, the cleaning container extending in an axial direction of the image carrier and receiving the residual substance from the image carrier; a scraping member that extends in a longitudinal direction of the opening in the cleaning container and that scrapes off the residual substance from the image carrier by coming into contact with the image carrier; and an end-sealing member that is fixed to the cleaning container at least at one end of the opening in the longitudinal direction, that is in contact with a surface of the image carrier, and that seals a gap between the cleaning container and the image carrier at an end of the scraping member in a longitudinal direction of the scraping member. A surface of the end-sealing member that is in contact with the surface of the image carrier has a void in a region isolated from a surrounding region.

BRIEF DESCRIPTION OF THE DRAWINGS

Exemplary embodiments of the present invention will be described in detail based on the following figures, wherein:

FIG. 9A illustrates the case where the hole is provided and FIG. 9B illustrates the case where the hole is not provided for comparison;

FIG. 10A illustrates the arrangement of a photoconductor, a cleaning container, a scraping member, and an end-sealing member, and FIG. 10B illustrates the operation of the structure illustrated in FIG. 10A.

DETAILED DESCRIPTION

Summary of Exemplary Embodiment

Figure 1A:
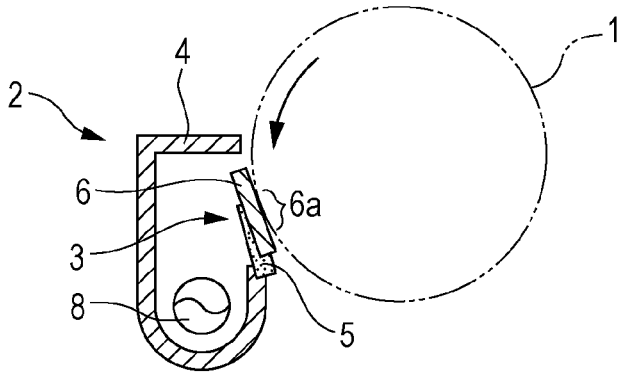
FIG. 1A is a schematic diagram illustrating a cleaning device according to an exemplary embodiment of the present invention.
Figure 1B:
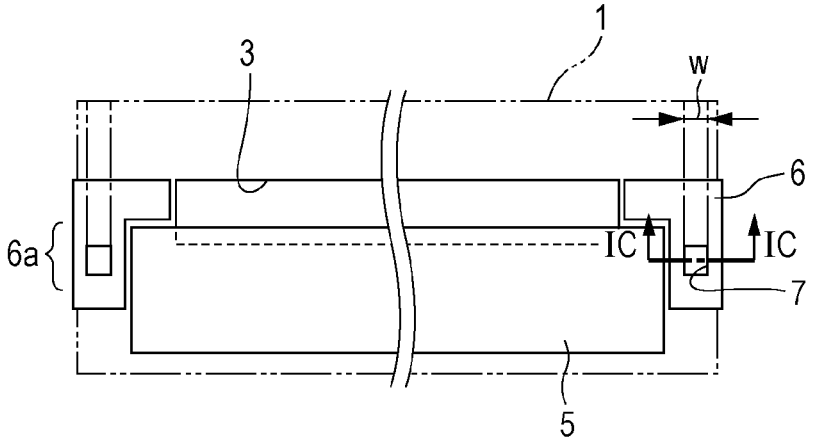
FIG. 1B is an enlarged view of a portion of FIG. 1A.
Figure 1C:
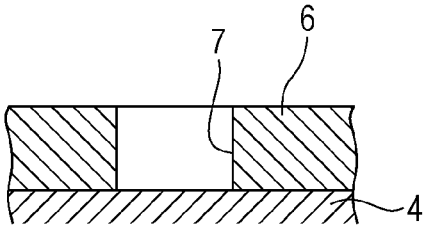
FIG. 1C illustrates a void formed in a sealing member.

FIG. 1A is a schematic diagram illustrating a cleaning device according to an exemplary embodiment of the present invention. FIG. 1B is an enlarged view of a portion of FIG. 1A. FIG. 1C is a sectional view of FIG. 1B taken along line IC-IC.

Referring to FIGS. 1A to 1C, a cleaning device 2 according to the present exemplary embodiment removes a residual substance from an image carrier 1 that rotates. The cleaning device 2 includes a cleaning container 4 that has an opening 3 facing the image carrier 1, that extends in an axial direction of the image carrier 1, and that receives the residual substance from the image carrier 1; a scraping member 5 that extends in a longitudinal direction of the opening 3 in the cleaning container 4 and that scrapes off the residual substance from the image carrier 1 by coming into contact with the image carrier 1; and an end-sealing member 6 that is fixed to the cleaning container 4 at least at one end of the opening 3 in the longitudinal direction, that is in contact with a surface of the image carrier 1, and that seals a gap between the cleaning container 4 and the image carrier 1 at an end of the scraping member 5 in a longitudinal direction of the scraping member 5. A surface of the end-sealing member 6 that is in contact with the surface of the image carrier 1 (portion corresponding to a contact region 6*a* in FIGS. 1A and 1B) has a void 7 in a region isolated from a surrounding region.

In the above-described technical idea, the residual substance includes not only toner on the image carrier 1 but also dust or the like that is generated due to sliding wear. The scraping member 5 may be a plate-shaped member, and is generally an elastic blade. However, the scraping member 5 is not limited to this, and may instead be roll-shaped. For example, the scraping member 5 may be a brush roller. There is no particular limitation regarding the end-sealing member 6 as long as the end-sealing member 6 is capable of scraping the residual substance off the image carrier 1 without damaging the image carrier 1. The end-sealing member 6 is made of, for example, a felt material. In the present exemplary embodiment, the void 7 is a hole with a bottom or a through hole (such as the hole illustrated in FIG. 1C) formed in the end-sealing member 6. There is no particular limitation regarding the shape of the void 7, and any number of voids 7 may be provided. The void 7 may have, for example, a rectangular shape, a circular shape, or a triangular shape in plan view, and a mixture of holes with a bottom and through holes may be formed. In the case where plural voids 7 are provided, the voids 7 may be arranged in a direction in which the image carrier 1 rotates.

Representative or suitable examples of the present exemplary embodiment will be described.

To make it easier to introduce the residual substance removed from the image carrier 1 into the void 7, the void 7 may have a narrow portion having a width in a width direction that gradually decreases toward a downstream side in a direction in which the image carrier 1 rotates. In this case, since the void 7 is in contact with the image carrier 1 that rotates, the residual substance in a large area of the image carrier 1 at a wide portion of the void 7 is scraped off by a portion of the void 7 that protrudes toward the downstream side and that has a large contact length. Thus, the residual substance may be easily introduced into the void 7.

To make it still easier to introduce the residual substance into the void 7, as illustrated in FIG. 1A, the surface of the end-sealing member 6 that is in contact with the surface of the image carrier 1 (portion corresponding to the contact region 6*a* in FIGS. 1A and 1B) may be inclined downward toward the downstream side in the direction in which the image carrier 1 rotates. When the surface of the end-sealing member 6 is inclined, the residual substance that has been scraped off is easily introduced into the void 7 owing to the gravity applied to the residual substance. Thus, the utilization efficiency of the void 7 is increased.

To increase the amount of residual substance receivable by the void 7, the void 7 may include a hole that communicates with the inside of the cleaning container 4 and that extends through the end-sealing member 6. In the case where plural voids 7 are provided, one or more holes may be provided. When the void 7 in the end-sealing member 6 communicates with the inside of the cleaning container 4, the residual substance passes through the void 7 and is introduced into the cleaning container 4. Therefore, the void 7 may be prevented from becoming completely filled with the residual substance.

In the case where the void 7 includes a hole, to increase the amount of receivable residual substance by a large amount, a transporting member 8 may be disposed in the cleaning container 4. The transporting member 8 extends in the longitudinal direction of the scraping member 5, and transports the residual substance in the cleaning container 4 to the outside of the cleaning container 4. The hole communicates with a region around the transporting member 8. When the transporting member 8 is provided, the residual substance is discharged out of the cleaning container 4. It is not necessary that the transporting member 8 be located below the hole. Even when, for example, the transporting member 8 is located so as to overlap the hole in a horizontal direction, the residual substance in the hole is pushed toward the transporting member 8 since the hole is in contact with the image carrier 1.

To cause the residual substance to smoothly flow from the hole to the transporting member 8, the transporting member 8 may be located below the hole.

An image forming apparatus including the cleaning device 2 may be structured as follows. That is, the image forming apparatus may include the image carrier 1 capable of carrying an electrostatic latent image, a developer carrier (not shown) that carries a developer used to develop the electrostatic latent image on the image carrier 1, and the above-described cleaning device 2.

To bring a spacing member, which provides a predetermined gap between the image carrier 1 and the developer carrier, into stable contact with the image carrier 1, a maximum width w of the void 7 in a direction that crosses the direction in which the image carrier 1 rotates may be set so as to be greater than a width of a region in which the spacing member for providing the predetermined gap between the image carrier 1 and the developer carrier is in contact with the image carrier 1. When the maximum width w is greater than the width of the region in which the spacing member is in contact with the image carrier 1, the residual substance on the image carrier 1 in this region is removed by the void 7 in the end-sealing member 6. Accordingly, when the spacing member is located in this region, since the image carrier 1 is cleaned, the spacing member comes into stable contact with the image carrier 1. As a result, the gap between the image carrier 1 and the developer carrier does not vary. Accordingly, the electrostatic latent image on the image carrier 1 may be developed under stable developing conditions.

In the above-described image forming apparatus, a charging member that charges the image carrier 1 may be disposed below the cleaning device 2. In general, there is no particular limitation regarding the location of the charging member with respect to the cleaning device 2. However, in the case where the charging member is disposed below the cleaning device 2, when the end-sealing member 6 is not provided with the void 7, the residual substance removed from the image carrier 1 easily falls. In this case, when, in particular, the charging member is a roller member, there is a risk that stains on a surface of the charging member or a shaft portion of the charging member will cause a change in the charging performance, and this may lead to a reduction in image quality. However, when the end-sealing member 6 having the void 7 is used, the residual substance is introduced into the void 7, and the risk that the charging member will be stained may be reduced. Therefore, according to the present exemplary embodiment, the layout flexibility of the charging member is significantly increased. The charging member is not limited to a roller member, and may instead be a member that utilizes corona discharge.

The end-sealing member 6 may be considered an exemplary embodiment of the present invention. In such a case, the end-sealing member 6 has the following features.

That is, the end-sealing member 6 is included in the cleaning device 2 including the cleaning container 4 and the scraping member 5, the cleaning container 4 having the opening 3 that faces the image carrier 1 that carries a toner image, extending in the axial direction of the image carrier 1, and receiving the residual substance from the image carrier 1, the scraping member 5 extending in the longitudinal direction of the opening 3 in the cleaning container 4 and scraping off the residual substance from the image carrier 1 by coming into contact with the image carrier 1. The end-sealing member 6 is fixed to the cleaning container 4 at least at one end of the opening 3 in the longitudinal direction, is in contact with the surface of the image carrier 1, and seals the gap between the cleaning container 4 and the image carrier 1 at an end of the scraping member 5 in the longitudinal direction of the scraping member 5. The surface of the end-sealing member 6 that is in contact with the surface of the image carrier 1 has the void 7 in the region isolated from a surrounding region.

An exemplary embodiment of the present invention will be described in detail with reference to the accompanying drawings.

Exemplary Embodiment 1

Overall Structure of Image Forming Apparatus

Figure 2:
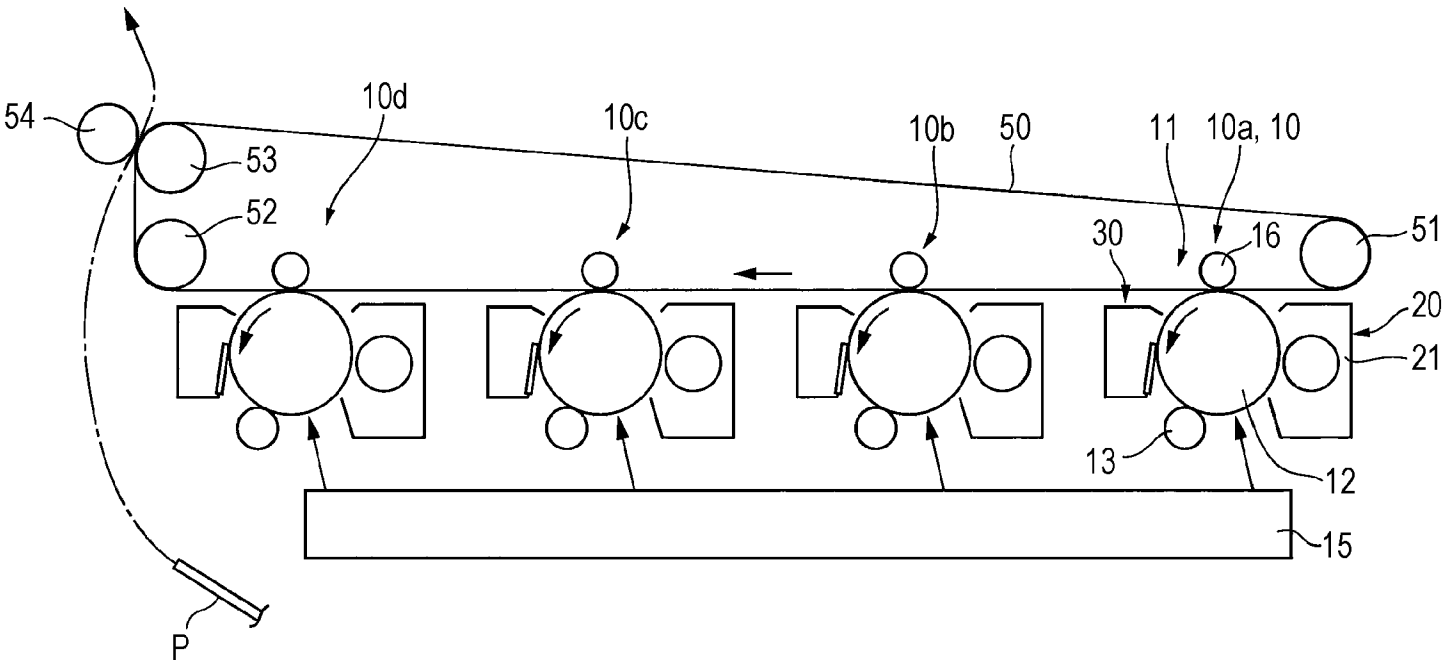
FIG. 2 is a schematic diagram illustrating an image forming apparatus according to Exemplary Embodiment 1 of the present invention.

FIG. 2 is a schematic diagram of an image forming apparatus according to an exemplary embodiment of the present invention. Referring to FIG. 2, the image forming apparatus according to the present exemplary embodiment has the structure of a color printer which uses two-component developers of four colors, each two-component developer containing toner and carrier. Image forming units 10 (10*a* to 10*d*) of the respective colors are arranged along a single line in a substantially horizontal direction. An endless intermediate transfer belt 50 that extends around three stretching rollers 51 to 53 is disposed above the image forming units 10.

The image forming units 10*a* to 10*d* have similar structures. Therefore, the image forming unit 10*a* will be described as an example. Each image forming unit 10 includes a photoconductor 12 that has a photosensitive layer on a surface thereof and that serves as an image carrier capable of carrying an electrostatic latent image. Various members used to form an image are arranged around the photoconductor 12. These members include a charging roller 13 that serves as a charging member for charging the photoconductor 12, an exposure device 15 that irradiates the charged photoconductor 12 with light so as to form an electrostatic latent image, a developing device 21 that develops the electrostatic latent image on the photoconductor 12, a first transfer device 16 that performs a first transfer process for transferring the developed toner image on the photoconductor 12 onto the intermediate transfer belt 50, and a cleaning device 30 that removes a residual substance from the photoconductor 12 after the transfer process.

In the present exemplary embodiment, a single exposure device 15 is provided for the four image forming units 10*a* to 10*d*. The exposure device 15 emits laser beams toward the four photoconductors 12 by using polygonal mirrors, lenses, and the like. However, the present invention is not limited to this, and the image forming units 10*a* and 10*d* may instead be provided with dedicated exposure devices. The exposure device 15 may instead include, for example, a light emitting diode (LED). Although the charging roller 13 is provided as a charging member in this exemplary embodiment, a charging member that utilizes corona discharge may instead be provided.

Among the three stretching rollers 51 to 53, the stretching roller 52, for example, serves as a driving roller so that the intermediate transfer belt 50 rotates in the direction shown by the arrow in FIG. 2. A second transfer device 54 is disposed so as to face the stretching roller 53 with the intermediate transfer belt 50 interposed therebetween. The second transfer device 54 simultaneously transfers the toner images on the intermediate transfer belt 50 onto a recording medium P that has been supplied from a recording-medium supplying unit (not shown). The toner images that have been simultaneously transferred onto the recording medium P are fixed by a fixing device (not shown), and then the recording medium P is ejected out of the image forming apparatus.

Figure 3A:
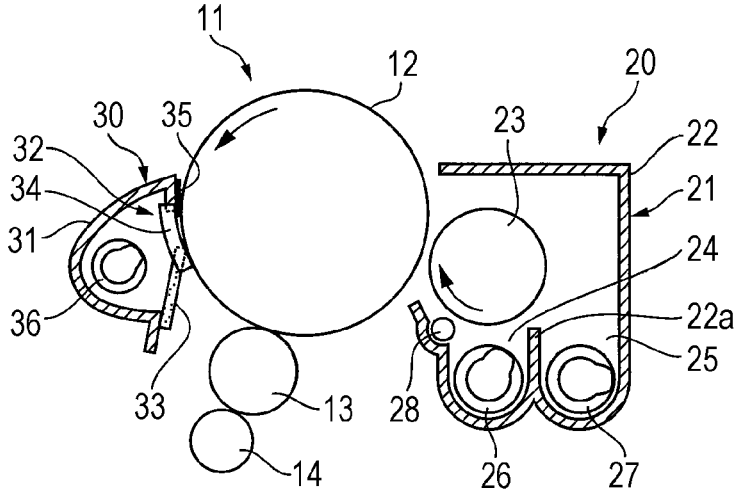
FIG. 3A illustrates components of a photoconductor unit and a developing unit.
Figure 3B:
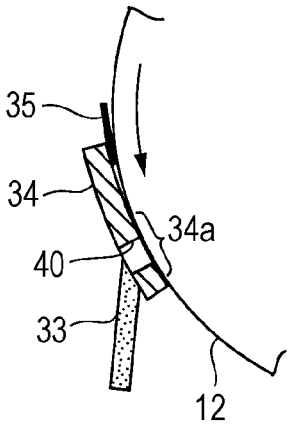
FIG. 3B is an enlarged view of a portion of FIG. 3A.
Figure 3C:
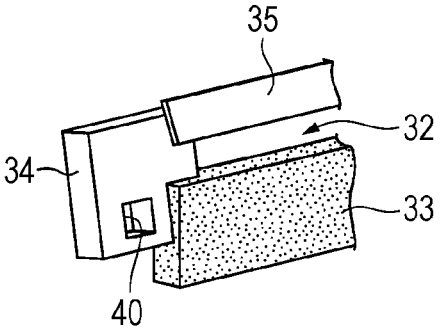
FIG. 3C is a perspective view of the portion illustrated in FIG. 3B.

In the present exemplary embodiment, the photoconductor 12, the charging roller 13, and the cleaning device 30 are components of a photoconductor unit 11, and the developing device 21 is a component of a developing unit 20. The photoconductor unit 11 and the developing unit 20 are assembled together. FIG. 3A illustrates components of the photoconductor unit 11 and the developing unit 20. FIG. 3B is an enlarged view of a portion of FIG. 3A. FIG. 3C is a perspective view of a portion of FIG. 3B.

Structure of Photoconductor Unit

The photoconductor unit 11 includes the photoconductor 12, the charging roller 13, and the cleaning device 30. The charging roller 13 is rotated by the rotation of the photoconductor 12. A cleaner 14 is located at a side of the charging roller 13 opposite a side at which the photoconductor 12 is located. The cleaner 14 is urged against the charging roller 13 by an urging member (not shown), and cleans the surface of the charging roller 13 that is rotated.

Structure of Cleaning Device

The cleaning device 30 includes a cleaning container 31, a scraping member 33, end-sealing members 34, and a long sealing member 35. The cleaning container 31 has an opening 32 facing the photoconductor 12, extends in an axial direction of the photoconductor 12, and receives the residual substance on the photoconductor 12. The scraping member 33 includes a proximal portion that is fixed to a side edge of the opening 32 that extends in a longitudinal direction, and a distal portion that extends toward the other side edge of the opening 32 that extends in the longitudinal direction. The scraping member 33 scrapes off the residual substance on the photoconductor 12 by coming into contact with the photoconductor 12 at the distal portion thereof. The end-sealing members 34 are fixed to the cleaning container 31 at both ends of the opening 32 in the longitudinal direction. The end-sealing members 34 are in contact with the end portions of the scraping member 33 in the longitudinal direction and the surface of the photoconductor 12, and seal the gaps between the cleaning container 31 and the photoconductor 12 at both ends of the scraping member 33 in the longitudinal direction of the scraping member 33. The long sealing member 35 is arranged so as to extend from an upstream side edge of the opening 32 that extends in the longitudinal direction toward a downstream side in a direction in which the photoconductor 12 rotates. Both end portions of the long sealing member 35 are in contact with the corresponding end-sealing members 34, and a portion of the long sealing member 35 other than the end portions is in soft contact with the photoconductor 12. The long sealing member 35 seals a gap between the upstream side edge of the opening 32 in the direction in which the photoconductor 12 rotates and the photoconductor 12.

The cleaning device 30 according to the present exemplary embodiment further includes a transporting member 36 that is disposed in the cleaning container 31. The transporting member 36 extends in the longitudinal direction of the scraping member 33, and transports the residual substance received by the cleaning container 31 to the outside of the cleaning container 31. The transporting member 36 includes, for example, a rotating shaft and a helical blade provided on the rotating shaft. In the present exemplary embodiment, the cleaning device 30 is located above the charging roller 13.

The end-sealing members 34 according to the present exemplary embodiment have contact regions 34*a* in which the end-sealing members 34 are in contact with the photoconductor 12. The contact regions 34*a* are on the outer sides of the end portions of the scraping member 33. Each end-sealing member 34 has a hole 40, which serves as a void, that extends through the end-sealing member 34 in the contact region 34*a* at a location isolated from a surrounding region. The contact region 34*a* is inclined downward toward the downstream side in the direction in which the photoconductor 12 rotates. In the present exemplary embodiment, the hole 40 has a rectangular shape in cross section.

Each end-sealing member 34 is made of a material that is soft so that the surface of the photoconductor 12 is not damaged when the end-sealing member 34 comes into contact therewith, that is capable of scraping off a certain amount of residual substance, and that has a certain degree of elasticity. For example, the end-sealing member 34 is made of a felt material. The end-sealing member 34 and the hole 40 in the end-sealing member 34 are formed by, for example, a punching process. A piece of double-sided tape or the like is applied to the end-sealing member 34 at one side thereof, and the end-sealing member 34 in this state is fixed to the cleaning container 31. Accordingly, the hole 40 that serves as a void according to the present exemplary embodiment has a bottom.

The long sealing member 35 is formed of a flexible film sheet that is soft enough so as not to damage the photoconductor 12, and a portion of the long sealing member 35 is fixed to the cleaning container 31.

Structure of Developing Unit

The developing unit 20 according to the present exemplary embodiment includes a developing roller 23 that is disposed in an opening in a developing container 22, which is a housing container of the developing device 21. The developing roller 23 serves as a developer carrier that carries and transports two-component developer, which contains toner and carrier, while a predetermined gap is provided between the developing roller 23 and the photoconductor 12. Two stirring-and-transporting members 26 and 27, which transport the developer while stirring the developer, are provided below the developing roller 23 in the developing container 22. The stirring-and-transporting members 26 and 27 are disposed in two developer transport paths 24 and 25, respectively, which are separated from each other by a partition wall 22*a*, which is a portion of the developing container 22. The partition wall 22*a* has communication paths (not shown) that connect the two developer transport paths 24 and 25 at both ends of the partition wall 22*a* in the longitudinal direction of the developer transport paths 24 and 25. When the stirring-and-transporting members 26 and 27 are rotated, the developer is circulated between the two developer transport paths 24 and 25. A layer-thickness regulating member 28, which regulates the thickness of the layer of the developer on the developing roller 23, is disposed below the developing roller 23.

A pair of tracking rollers, which will be described below, are provided at both ends of a rotating shaft (not shown) of the developing roller 23. Each of the tracking rollers serves as a spacing member that provides a gap between the developing roller 23 and the photoconductor 12. In the present exemplary embodiment, the tracking rollers are in contact with both end portions of the photoconductor 12, that is, original-pipe portions (described in detail below) of the photoconductor 12 on which the photosensitive layer is not formed. Accordingly, the gap between the photoconductor 12 and the developing roller 23 is maintained constant, and the developing process may be performed under stable conditions.

Assembly of Photoconductor Unit and Developing Unit

Figure 4:
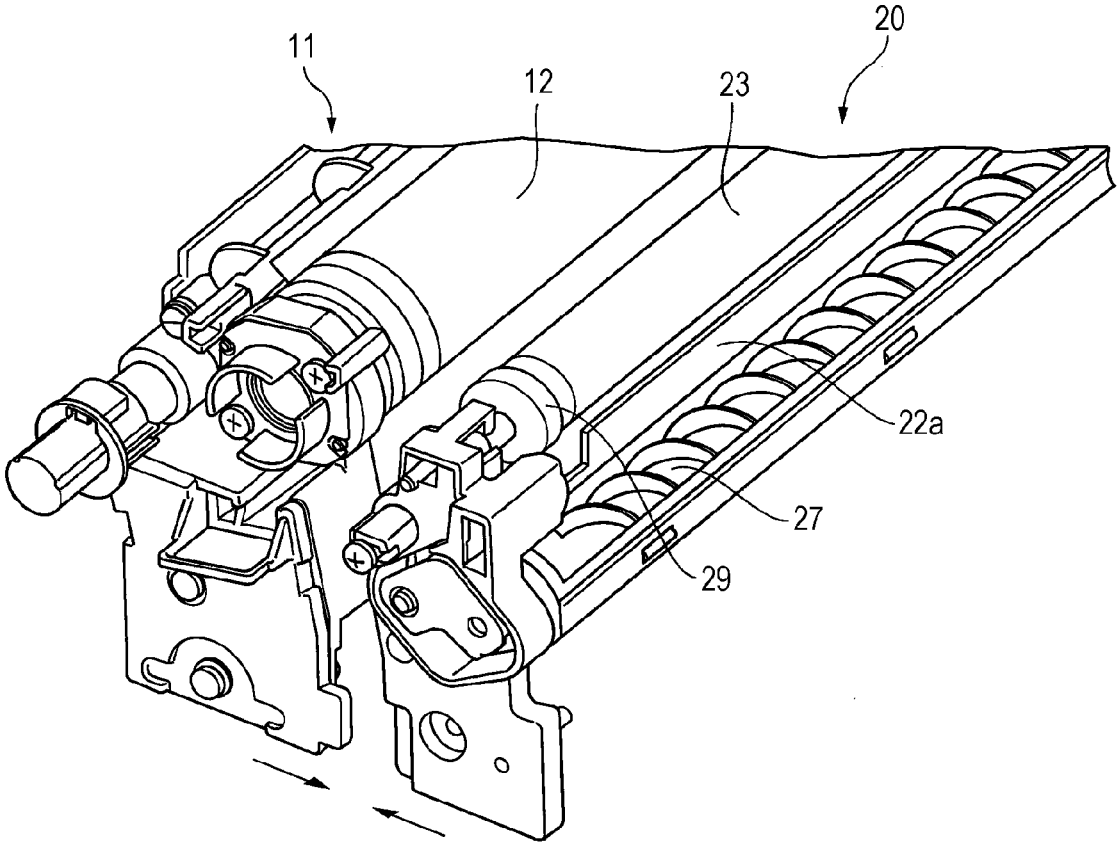
FIG. 4 is a perspective view of the photoconductor unit and the developing unit according to Exemplary Embodiment 1.

FIG. 4 is a perspective view of the assembly of the photoconductor unit 11 and the developing unit 20 according to the present exemplary embodiment. Tracking rollers 29 (only one of which is illustrated in FIG. 4) are fixed to the rotating shaft of the developing roller 23 of the developing unit 20 at both ends of the developing roller 23. In FIG. 4, the photoconductor unit 11 and the developing unit 20 are separated from each other. However, the photoconductor unit 11 and the developing unit 20 are, of course, moved in the directions shown by the arrows in FIG. 4 and brought into contact with each other.

In FIG. 4, the photoconductor unit 11 and the developing unit 20 of the image forming apparatus are assembled together, so that the tracking rollers 29 of the developing unit 20 come into contact with the photoconductor 12 of the photoconductor unit 11 and a predetermined constant gap is provided between the photoconductor 12 and the developing roller 23.

Figure 5:
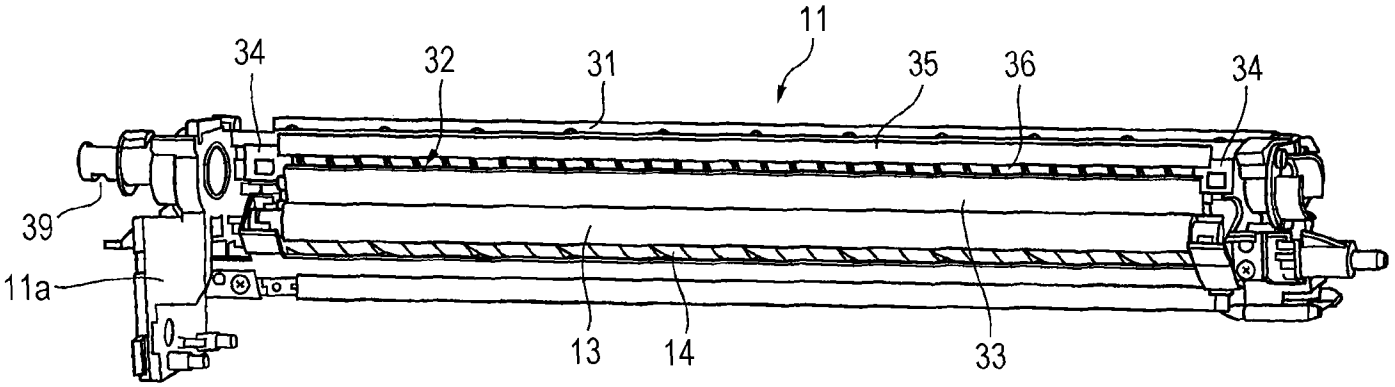
FIG. 5 is a perspective view illustrating the state in which a photoconductor is removed from the photoconductor unit according to Exemplary Embodiment 1.

FIG. 5 is a perspective view illustrating the state in which the photoconductor 12 is removed from the photoconductor unit 11. Referring to FIG. 5, in a region on the far side of the photoconductor 12 (side opposite to the side at which the developing unit 20 is provided), the scraping member 33, the two end-sealing members 34, which are provided at both ends of the scraping member 33 in the longitudinal direction, and the long sealing member 35 are fixed to the cleaning container 31. In the present exemplary embodiment, the cleaning container 31 is integrated with a unit housing 11*a* of the photoconductor unit 11. An outlet 39 is provided in a region outside the unit housing 11*a* at one end of the cleaning container 31 in the longitudinal direction. The residual substance, such as toner, collected in the cleaning container 31 is discharged out of the cleaning container 31 by the transporting member 36 through the outlet 39.

Figure 6:
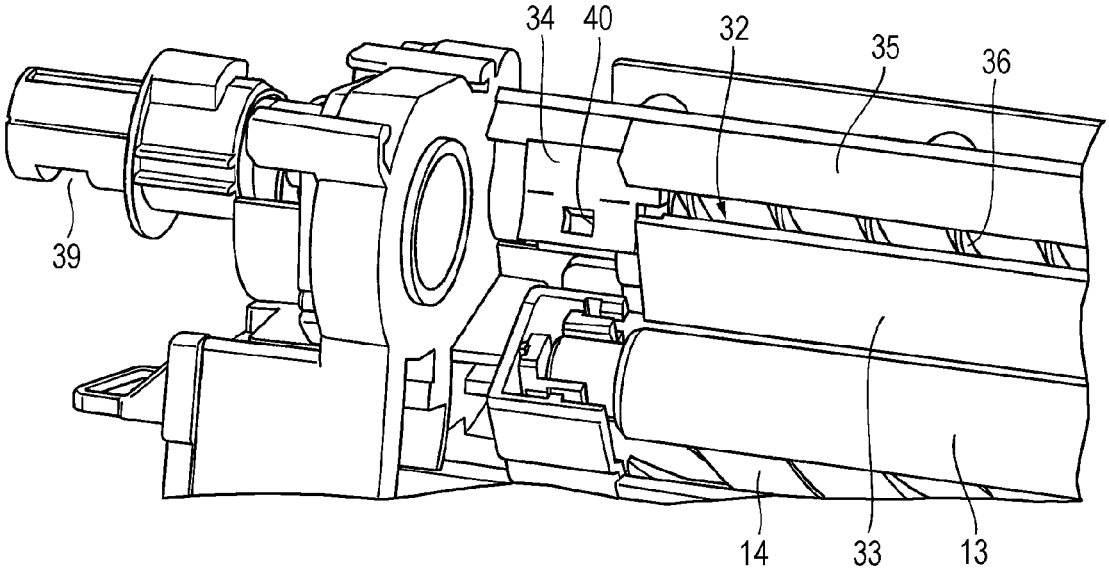
FIG. 6 is an enlarged perspective view of an end portion of a scraping member illustrated in FIG. 5 in a longitudinal direction.
Figure 7:
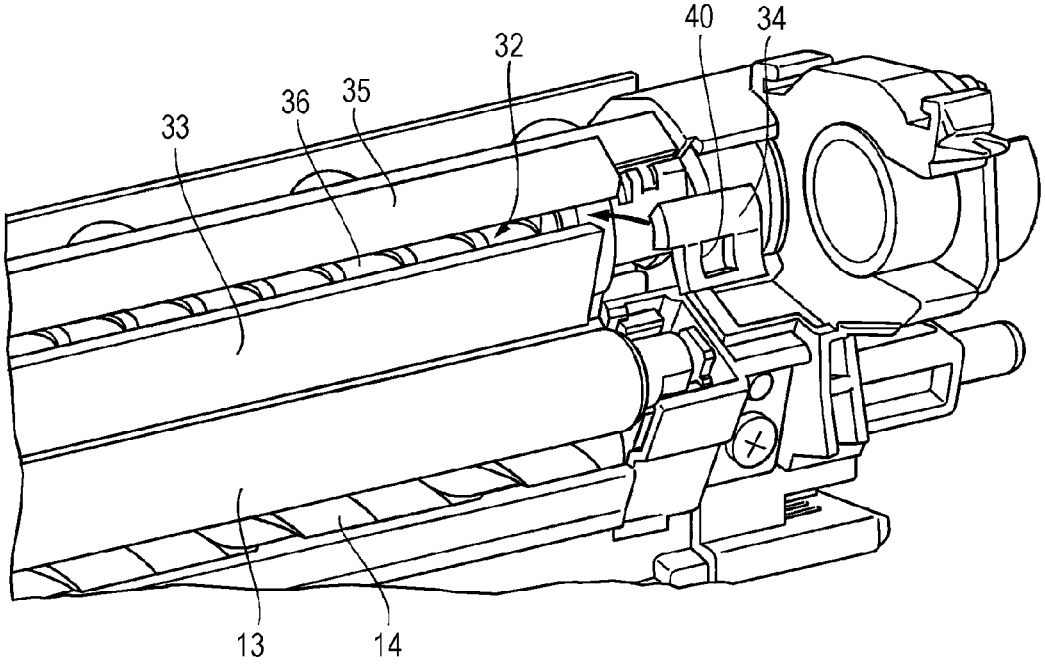
FIG. 7 is an enlarged perspective view of the other end portion of the scraping member illustrated in FIG. 5 in the longitudinal direction.

FIGS. 6 and 7 are enlarged perspective views of the end portions of the structure illustrated in FIG. 5 in the longitudinal direction of the scraping member 33. Referring to FIG. 6, the end-sealing members 34 (only one of which is illustrated in FIG. 6) are fixed to the cleaning container 31 at both ends of the opening 32 in the longitudinal direction. A portion of each end-sealing member 34 that is near the scraping member 33 is in contact with the photoconductor 12. The end-sealing member 34 has the hole 40, which serves as a rectangular void, in a contact region in which the end-sealing member 34 is in contact with the photoconductor 12. The end-sealing member 34 is in contact with a portion of the long sealing member 35, and is also in contact with an end portion of the scraping member 33.

FIG. 7 illustrates the state in which the end-sealing member 34 is not yet attached to the cleaning container 31. The end-sealing member 34 is attached to the cleaning container 31 such that the end-sealing member 34 extends along the corresponding edge of the opening 32 in the cleaning container 31. More specifically, the end-sealing member 34 is moved in the direction shown by the arrow, and is then fixed.

Figure 8:
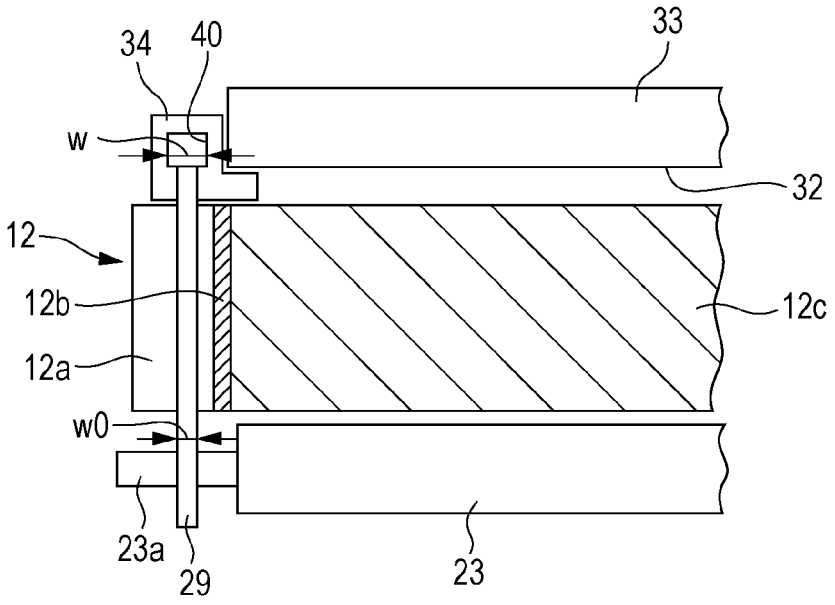
FIG. 8 is a schematic diagram illustrating the positional relationship between the photoconductor, a developing roller, the scraping member, and a sealing member according to Exemplary Embodiment 1.

FIG. 8 is a schematic diagram illustrating the positional relationship between the photoconductor 12, the developing roller 23, the scraping member 33, and each end-sealing member 34 according to the present exemplary embodiment. Referring to FIG. 8, the photoconductor 12 according to the present exemplary embodiment is obtained by forming a base treatment layer 12*b* for increasing the adhesion on an original pipe 12*a*, and then forming a photosensitive layer 12*c* made of an optical photo conductor (OPC) on the surface of the base treatment layer 12*b*. The gap between the photoconductor 12 and the developing roller 23 is maintained by the tracking roller 29 provided at each end of a rotating shaft 23*a* of the developing roller 23. In the present exemplary embodiment, the tracking roller 29 is in contact with the original pipe 12*a* of the photoconductor 12. Accordingly, the tracking roller 29 does not come into direct contact with the photosensitive layer 12*c*, and does not have a direct adverse effect on the photosensitive layer 12*c*. The length of the hole 40 in the end-sealing member 34 in the direction of the rotational axis of the photoconductor 12, that is, the maximum width w, is set so as to be greater than the width w0 of the tracking roller 29. In other words, the region in which the tracking roller 29 is in contact with the photoconductor 12 overlaps the hole 40 in the end-sealing member 34 in the axial direction, and the hole 40 has a rectangular shape that is longer than the tracking roller 29 in the axial direction.

Although the photosensitive layer 12*c* is made of the OPC in the present exemplary embodiment, the photosensitive layer 12*c* is not limited to a layer made of an organic material, and may instead be a layer made of an inorganic material, such as amorphous silicon.

Operation of Image Forming Apparatus

The operation of the image forming apparatus having the above-described structure will be described. Referring to FIG. 2, toner images of the respective colors are formed on the photoconductors 12 in the image forming units 10 (10*a* to 10*d*) of the respective colors, and the toner images of the respective colors formed on the photoconductors 12 are successively transferred onto the intermediate transfer belt 50 by the first transfer devices 16 in the first transfer process. The toner images of the respective colors are transferred onto the intermediate transfer belt 50 in a superposed manner. The superposed toner images are simultaneously transferred onto the recording medium P by the second transfer device 54. Then, the recording medium P passes through the fixing device (not shown), and is ejected out of the apparatus.

In this structure, the cleaning device 30 of each image forming unit 10 cleans the surface of the photoconductor 12 after the toner image formed on the photoconductor 12 is transferred onto the intermediate transfer belt 50 in the first transfer process. The residual substance, such as toner, that has remained on the photoconductor 12 is collected in the cleaning device 30.

Operation of Cleaning Device

The operation of the cleaning device 30 according to the present exemplary embodiment will be described with reference to FIGS. 3A to 8.

The residual substance that has been scraped off the photoconductor 12 by the scraping member 33 is collected in the cleaning container 31 through the opening 32 in the cleaning container 31. The transporting member 36 disposed in the cleaning container 31 is rotated so that the residual substance collected in the cleaning container 31 is transported toward the outlet 39, and is discharged from the outlet 39.

In this state, the residual substance that has been scraped off the photoconductor 12 easily spreads outward to the ends of the scraping member 33 in the longitudinal direction, and there is a risk that the residual substance on the photoconductor 12 will spread to regions outside the ends of the opening 32 in the cleaning container 31. There is also a risk that the residual substance will leak from both ends of the opening 32 in the cleaning container 31 in the longitudinal direction. Therefore, unless the residual substance in such a state is removed, there is a risk that image defects, such as stains, will occur due to scattering of the residual substance or the like. Moreover, there is also a risk that abrasion powder or the like will be generated when the photoconductor 12 slide along the tracking rollers 29. If the abrasion powder or the residual substance accumulates on the photoconductor 12, in particular, in regions in which the tracking rollers 29 are in contact with the photoconductor 12, the gap between the photoconductor 12 and the developing roller 23 varies, and the developing conditions vary accordingly.

In the present exemplary embodiment, the end-sealing members 34 are provided at both ends of the scraping member 33 and both ends of the opening 32 in the longitudinal direction, and the end-sealing members 34 are in contact with the photoconductor 12. Therefore, the residual substance and abrasion powder are removed by the end-sealing members 34 at both ends of the photoconductor 12.

Thus, the end-sealing members 34 clean the regions around both ends of the photoconductor 12 and both ends of the opening 32. However, when such a cleaning process is repeated, the residual substance accumulates on the end-sealing members 34 and the cleaning performance gradually decreases. Accordingly, in the present exemplary embodiment, each end-sealing member 34 has the hole 40, which serves as a void. Therefore, compared to the case in which each end-sealing member 34 is not provided with a void, such as the hole 40, the cleaning performance of the end-sealing member 34 may be maintained at a high level for a longer time. When, for example, each end-sealing member 34 is not provided with a void, such as the hole 40, the stains continuously accumulate on the surface of each end-sealing member 34 (in a contact region in which the end-sealing member 34 is in contact with the photoconductor 12) and it is expected that the end-sealing member 34 will be unable to provide the function of maintaining the surface of the photoconductor 12 clean. As a result, there is a risk that the residual substance will scatter, or the gap between the photoconductor 12 and the developing roller 23 provided by the tracking rollers 29 will vary and the image quality will be degraded.

The operation of the hole 40 according to the present exemplary embodiment will be described in detail with reference to FIGS. 9A and 9B. To facilitate understanding, FIG. 9A illustrates the state in which the hole 40 is provided, and FIG. 9B illustrates the state in which the hole 40 is not provided for comparison.

First, the structure according to the comparative example illustrated in FIG. 9B will be described.

Figure 9A:
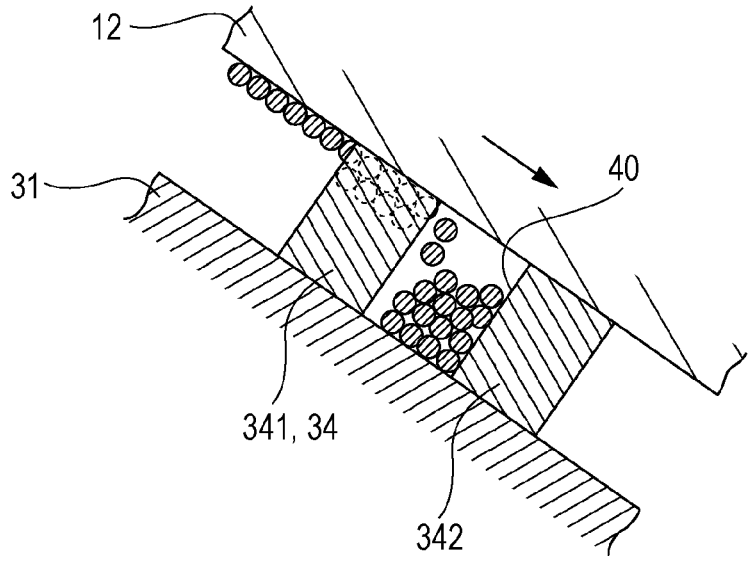
FIGS. 9A and 9B illustrate the operation of a hole, where
Figure 9B:
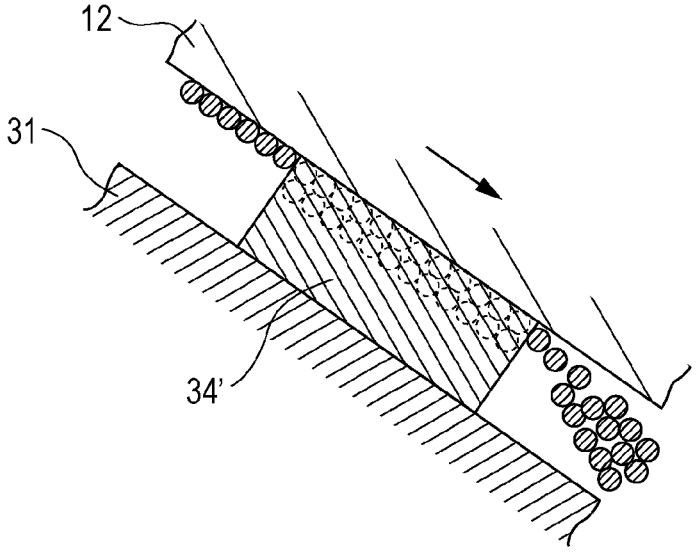
FIG. 9B RELATED ART

When the photoconductor 12 is rotated in the direction shown by the arrow, the residual substance on the photoconductor 12 (mainly toner particles shown by black circles in FIG. 9B) is scraped off by an end-sealing member 34' that is in contact with the photoconductor 12, and accumulates in the end-sealing member 34' (the accumulated residual substance is shown by dotted white circles in FIG. 9B). The end-sealing member 34' is made of, for example, a felt material. The spaces between the fibers of the felt material are gradually filled with the residual substance. When the operation of scraping off the residual substance is continuously performed, the amount of residual substance that fills the inner spaces of the end-sealing member 34' reaches a limit. After that, the residual substance leaks out from the exit side (downstream side in the direction in which the photoconductor 12 rotates). The residual substance that has leaked out in this manner scatters to the outside through the gap between the photoconductor 12 and the cleaning container 31, and causes, for example, a reduction in image quality or the like.

In contrast, when the hole 40 is formed in the end-sealing member 34 as in the example illustrated in FIG. 9A, the residual substance on the photoconductor 12 is scraped off mainly by an upstream portion 341 of the end-sealing member 34, the upstream portion 341 being located upstream of the hole 40. After the upstream portion 341 is filled with the residual substance, the residual substance is received by the hole 40. In general, the end-sealing member 34 is not evenly filled with the residual substance in the thickness direction. More specifically, a portion of the end-sealing member 34 near a front surface (photoconductor-12-side surface in this example) of the end-sealing member 34 is more easily filled with the residual substance than a portion far from the front surface. In contrast, the hole 40 equally receives the residual substance irrespective of the location in the depth direction, and the residual substance accumulates from the bottom of the hole 40. Therefore, a far greater amount of residual substance may be received by the hole 40 compared to the case where the hole 40 is not provided. If the hole 40 becomes completely filled with the residual substance, a downstream portion 342 of the end-sealing member 34 starts to scrape off the residual substance. Therefore, the risk that the residual substance will scatter from the gap between the photoconductor 12 and the cleaning container 31 is greatly reduced.

As described above, since the hole 40 is formed in each end-sealing member 34 according to the present exemplary embodiment, the residual substance that has accumulated in a contact region of the end-sealing member 34 is gradually introduced into the hole 40, and the accumulation of the residual substance in the end-sealing member 34 is suppressed. As a result, the surface of the photoconductor 12 that is in contact with the end-sealing member 34 is maintained clean for a long time. In addition, in the present exemplary embodiment, the maximum width of the hole 40 in each end-sealing member 34 is greater than the width of the contact region between the corresponding tracking roller 29 and the photoconductor 12. Therefore, stains on a portion of the photoconductor 12 that comes into contact with the tracking roller 29 are removed by the end-sealing member 34, and the residual substance or the like that has been removed is collected in the hole 40. Therefore, an appropriate gap is constantly provided between the photoconductor 12 and the developing roller 23.

In the present exemplary embodiment, the charging roller 13 is disposed below the scraping member 33. Even in such a structure, when the cleaning device 30 according to the present exemplary embodiment is used, degradation of charging conditions due to scattering of the residual substance or the like may be suppressed.

Although the image forming apparatus is a color image forming apparatus in the present exemplary embodiment, the image forming apparatus is not limited to this, and may instead be a monochrome image forming apparatus.

Although the tracking rollers 29 are used as spacing members that provide a gap between the photoconductor 12 and the developing roller 23, members having a function similar to that of the spacing members may be provided on, for example, a component other than the developing roller 23. Moreover, the tracking rollers 29 may instead be configured such that portions thereof are in contact with a component other than the photoconductor 12.

In the present exemplary embodiment, the hole 40 is formed in each end-sealing member 34 as a void. However, a recess having a bottom may be provided instead of the hole 40. However, the amount of residual substance that is receivable by the recess is, of course, smaller than the amount of residual substance receivable by the hole 40.

In the present exemplary embodiment, the transporting member 36 is disposed in the cleaning container 31. However, the transporting member 36 may be omitted, and the residual substance may be collected in the cleaning container 31.

Figure 10A:
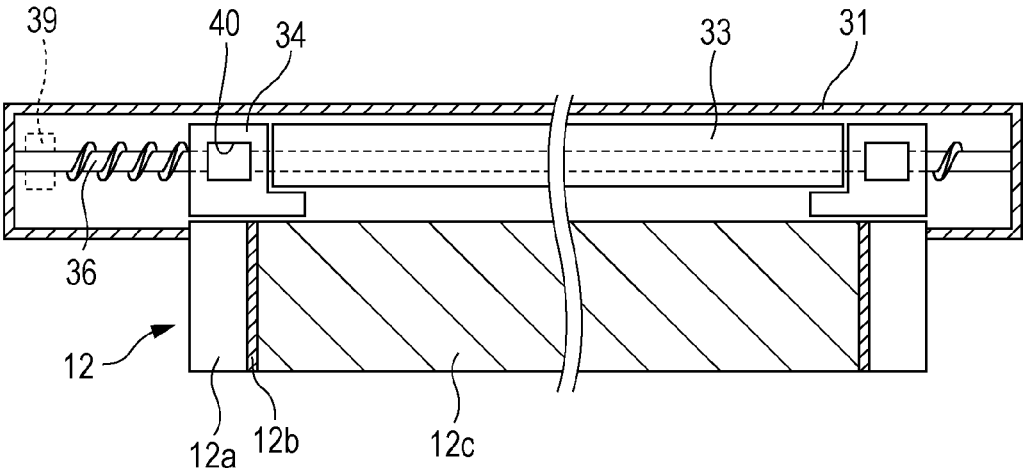
FIGS. 10A and 10B illustrate a modification of Exemplary Embodiment 1, where
Figure 10B:
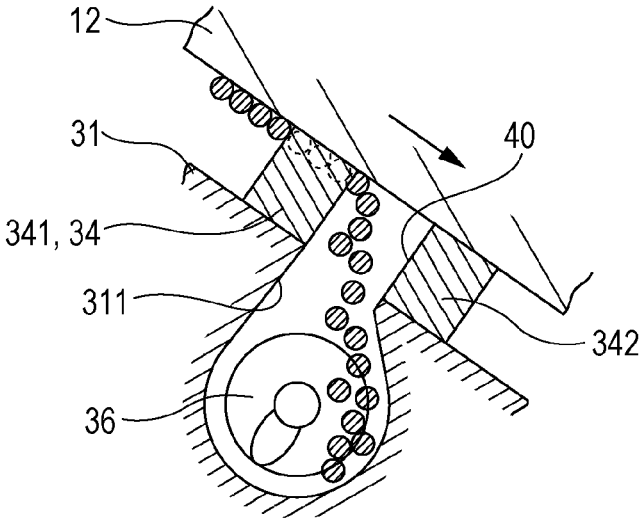

In the present exemplary embodiment, the hole 40 is formed in each end-sealing member 34. However, the structure illustrated in FIGS. 10A and 10B may instead be employed. FIGS. 10A and 10B illustrate a modification of the above-described exemplary embodiment. FIG. 10A is a schematic diagram illustrating the arrangement of the photoconductor 12, the cleaning container 31, the scraping member 33, and the end-sealing members 34. FIG. 10B is a schematic diagram illustrating the operation.

In the example illustrated in FIGS. 10A and 10B, the cleaning container 31 has a communication hole 311 at a position directly below the hole 40 in each end-sealing member 34, so that the hole 40 communicates with the cleaning container 31.

In this structure, the residual substance (shown by black circles in FIG. 10B) that has been scraped off by the upstream portion 341 of the end-sealing member 34 accumulates in the upstream portion 341 (shown by dotted white circles in FIG. 10B), and is then gradually introduced into the hole 40. Since the hole 40 communicates with the cleaning container 31, the residual substance is immediately introduced into the cleaning container 31 from the hole 40. The residual substance that has been introduced into the cleaning container 31 (shown by black circles in FIG. 10B) is transported to the outlet 39 by the transporting member 36. Therefore, the cleaning performance of the end-sealing member 34 is maintained at a high level for a long time.

Although the rectangular hole 40 is formed as a void in each end-sealing member 34 in the above-described example, the void may instead have shapes illustrated in FIGS. 11A to 11D. To facilitate understanding, the voids are denoted by 40. In FIGS. 11A to 11D, the arrow d indicates the rotating direction of the photoconductor.

Figure 11A:
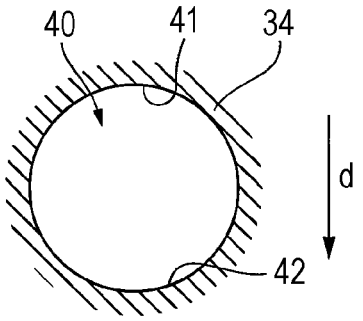
FIGS. 11A to 11D illustrate voids having various shapes.

In FIG. 11A, the void 40 has a circular shape. The manner in which the residual substance is collected in the case where the void 40 has a circular shape will be described.

In this case, the periphery of the void 40 is a combination of an upstream semicircular portion 41 and a downstream semicircular portion 42 that are respectively disposed at the upstream and downstream sides in the d direction. The upstream semicircular portion 41 scrapes off the residual substance and tries to introduce the residual substance into the void 40. However, since the void 40 is disposed behind the upstream semicircular portion 41, the effect of pushing the residual substance into the void 40 is not sufficient. Therefore, it is necessary for the downstream semicircular portion 42 to push the residual substance into the void 40. The downstream semicircular portion 42 projects toward the downstream side in the d direction, and the width thereof in a width direction that crosses the d direction gradually decreases toward the downstream side in the d direction. Therefore, compared to the case in which the downstream semicircular portion 42 has a simple linear shape that crosses the d direction, the length of the ridge is increased and the effect of scraping off the residual substance is enhanced. In addition, the residual substance is collected toward the center in the direction that crosses the d direction. Thus, the residual substance is collected in the void 40.

Figure 11B:
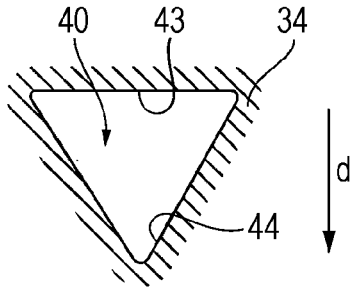

A similar effect may be obtained when the void 40 has a triangular shape as illustrated in FIG. 11B. The void 40 has an upstream linear portion 43 that scrapes off the residual substance in a large region, and a downstream triangular portion 44 (portion inclined with respect to the d direction) has a long ridge. Accordingly, the residual substance may be easily collected in the void 40.

Figure 11C:
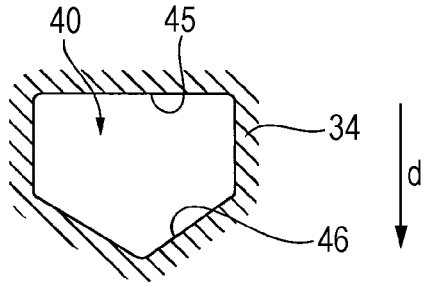

FIG. 11C is a modification of FIG. 11B, and the void 40 has a pentagonal shape. The residual substance is scraped off by an upstream linear portion 45 in a large region, and the residual substance that has been scraped off by a downstream triangular portion 46 may be easily collected in the void 40.

Figure 11D:
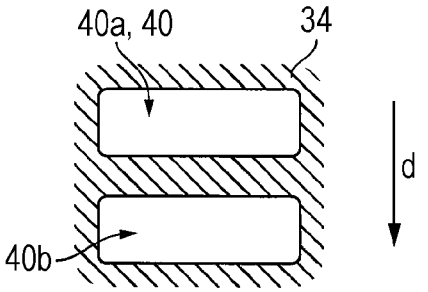

In FIG. 11D, two voids 40 (40*a* and 40*b*) are arranged in the d direction. In this structure, the two voids 40*a* and 40*b* successively scrape off the residual substance that remains in the same region, so that the residual substance is effectively collected in the voids 40.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

The invention claimed is:

1. A cleaning device that removes a residual substance from an image carrier that rotates, the cleaning device comprising:

a cleaning container comprising an opening that faces the image carrier, the cleaning container extending in an axial direction of the image carrier and configured to receive the residual substance from the image carrier;

a scraping member extending in a longitudinal direction of the opening in the cleaning container and configured to scrape off the residual substance from the image carrier by contact; and an end-sealing member that is fixed to the cleaning container at least at one end of the opening in the longitudinal direction, that is in contact with a surface of the image carrier, and configured to seal a gap between the cleaning container and the image carrier at an end of the scraping member in a longitudinal direction of the scraping member, wherein a surface of the end-sealing member that is in contact with the surface of the image carrier has a void in a region isolated from a surrounding region, and wherein the end sealing member is inclined such that an upstream side of the end-sealing member is disposed farther away from the image carrier than a downstream side of the end-sealing members in a direction in which the image carrier rotates.

2. The cleaning device according to claim 1, wherein the surface of the end-sealing member that is in contact with the surface of the image carrier is inclined downward toward a downstream side in a direction in which the image carrier rotates.

3. The cleaning device according to claim 2, wherein the void includes a hole that communicates with an inside of the cleaning container and that extends through the end-sealing member.

4. The cleaning device according to claim 3, further comprising:

a transporting member disposed in the cleaning container, the transporting member extending in the longitudinal direction of the scraping member and transporting the residual substance in the cleaning container to an outside of the cleaning container, and wherein the hole that serves as the void communicates with a region around the transporting member.

5. The cleaning device according to claim 4, wherein the transporting member is located below the hole that serves as the void.

6. The cleaning device according to claim 1, wherein the void includes a hole that communicates with an inside of the cleaning container and that extends through the end-sealing member.

7. The cleaning device according to claim 6, further comprising:

a transporting member disposed in the cleaning container, the transporting member extending in the longitudinal direction of the scraping member and transporting the residual substance in the cleaning container to an outside of the cleaning container, and wherein the hole that serves as the void communicates with a region around the transporting member.

8. The cleaning device according to claim 7, wherein the transporting member is located below the hole that serves as the void.

9. An image forming apparatus comprising:

an image carrier capable of carrying an electrostatic latent image;

a developer carrier that carries a developer used to develop the electrostatic latent image on the image carrier; and the cleaning device according to claim 1.

10. The image forming apparatus according to claim 9, wherein a maximum width of the void in the axial direction of the image carrier is set so as to be greater than a width of a region in which a spacing member for providing a predetermined gap between the image carrier and the developer carrier is in contact with the image carrier.

11. The image forming apparatus according to claim 9, further comprising:

a charging member configured to charge the image carrier, the charging member being located below the cleaning device.

12. A cleaning device that removes a residual substance from an image carrier that rotates, the cleaning device comprising:

a cleaning container comprising an opening that faces the image carrier, the cleaning container extending in an axial direction of the image carrier and configured to receive the residual substance from the image carrier;

a scraping member extending in a longitudinal direction of the opening in the cleaning container and configured to scrape off the residual substance from the image carrier by contact; and an end-sealing member that is fixed to the cleaning container at least at one end of the opening in the longitudinal direction, that is in contact with a surface of the image carrier, and configured to seal a gap between the cleaning container and the image carrier at an end of the scraping member in a longitudinal direction of the scraping member, wherein a surface of the end-sealing member that is in contact with the surface of the image carrier has a void in a region isolated from a surrounding region, and wherein the void has a narrow portion having a width in a width direction that gradually decreases toward a downstream side in a direction in which the image carrier rotates.

13. The cleaning device according to claim 12, wherein the surface of the end-sealing member that is in contact with the surface of the image carrier is inclined downward toward a downstream side in a direction in which the image carrier rotates.

14. The cleaning device according to claim 13, wherein the void includes a hole that communicates with an inside of the cleaning container and that extends through the end-sealing member.

15. The cleaning device according to claim 14, further comprising:

a transporting member disposed in the cleaning container, the transporting member extending in the longitudinal direction of the scraping member and transporting the residual substance in the cleaning container to an outside of the cleaning container, and wherein the hole that serves as the void communicates with a region around the transporting member.

16. The cleaning device according to claim 15, wherein the transporting member is located below the hole that serves as the void.

17. The cleaning device according to claim 12, wherein the void includes a hole that communicates with an inside of the cleaning container and that extends through the end-sealing member.

18. The cleaning device according to claim 17, further comprising:

a transporting member disposed in the cleaning container, the transporting member extending in the longitudinal direction of the scraping member and transporting the residual substance in the cleaning container to an outside of the cleaning container, and wherein the hole that serves as the void communicates with a region around the transporting member.

19. The cleaning device according to claim 18, wherein the transporting member is located below the hole that serves as the void.

20. An end-sealing member for a cleaning device including a cleaning container and a scraping member, the cleaning container having an opening that faces an image carrier that carries a toner image, extending in an axial direction of the image carrier, and receiving a residual substance from the image carrier, and the scraping member extending in a longitudinal direction of the opening in the cleaning container and scraping off the residual substance from the image carrier by coming into contact with the image carrier, wherein the end-sealing member is fixed to the cleaning container at least at one end of the opening in the longitudinal direction, and is in contact with a surface of the image carrier, a surface of the end-sealing member that is in contact with the surface of the image carrier has a void in a region isolated from a surrounding region, and the end-sealing member seals a gap between the cleaning container and the image carrier at an end of the scraping member in a longitudinal direction of the scraping member, and wherein the end sealing member is inclined such that upstream side of the end-sealing member is disposed farther away from the image carrier than a downstream side of the end-sealing members in a direction in which the image carrier rotates.

* * * * *